United States Patent [19]

Bourree et al.

[11] 4,015,807

[45] Apr. 5, 1977

[54] LOGIC PASSING DEVICE FOR AUTOMATIC RAILWAY PILOTING

[75] Inventors: Guy Bourree, Paris; Claude Pontier, Velizy, both of France

[73] Assignee: Societe Generale de Constructions Electriques et Mecaniques (ALSTHOM), Paris, France

[22] Filed: Mar. 31, 1976

[21] Appl. No.: 672,443

[30] Foreign Application Priority Data

Apr. 4, 1975 France ..... 75.10610

[52] U.S. Cl. ..... 246/187 B; 246/167 R; 246/187 C

[51] Int. Cl.[2] ..... B61L 3/24

[58] Field of Search ..... 246/182 B, 187 B, 187 C, 246/34 R, 40, 167 R, 177

[56] References Cited

UNITED STATES PATENTS

| | | | |
|---|---|---|---|
| 3,202,816 | 8/1965 | Gregg | 246/187 B |
| 3,361,905 | 1/1968 | Baughman | 246/187 C |
| 3,402,289 | 9/1968 | Burke | 246/167 R |
| 3,501,629 | 3/1970 | Aiken | 246/187 B |
| 3,710,100 | 1/1973 | Perry | 246/187 B |
| 3,748,466 | 7/1973 | Sibley | 246/187 B |
| 3,819,932 | 6/1974 | Auer | 246/187 B |

*Primary Examiner*—Trygve M. Blix
*Assistant Examiner*—Reinhard J. Eisenzopf

[57] ABSTRACT

Logic passing method and device enabling an automatic pilot-driving of trains in the section of track which follows the section occupied by a preceding train. The method consists in determining the rules for allowing and preventing and in implementing them by a logic passing device in which memories are set by first data and activated by second data. Applications: signals on railways or underground systems.

3 Claims, 2 Drawing Figures

LOGIC PASSING DEVICE FOR AUTOMATIC RAILWAY PILOTING

The present invention concerns a logic passing device for automatic railway piloting and, more particularly, a device enabling an upstream train not to crash into a train driving or stopped downstream.

It is known that in certain types of automatic piloting, each section of the track is equipped with a closed loop circuit arranged inside the said sections and parallel to the track. Each closed loop circuit is equipped with a signal emitter, the trains receiving those signals by means of sensors with which they are provided. In closed looped circuit systems, a train does not prevent the data from circulating inside the closed loop circuit of the section, even upstream from the train. It is not always possible for a train to stop in the limit of the section when it has received the order to do so. When the train which receives the order to stop passes the limits of a section, it again receives the order to drive on, even if the downstream section is still occupied. To avoid the consequences of that passing, which can be catastrophic, the system used up till now consisted in forming, upstream from the occupied section, a buffer section forbidden to the passing of the following trains. The disadvantage of that method resides in the fact that the distance between the trains which is imposed by the buffer section is prohibitive and thus the frequency of the trains is consequently very reduced.

The device according to the present invention makes it possible to obviate that disadvantage. Indeed, according to invention, the trains can follow each other in neighbouring sections, the frequency of the trains being increased, whereas sufficient safety conditions are ensured.

The present invention has as its object an automatic railway piloting method comprising a track divided into sections, each section comprising a closed loop circuit fed by an emitter on the ground sending out signals whose frequency is variable according to the speed limit other than zero or zero speed which the train must keep to in the said section, the engine of the train being equipped with sensors receiving the said signals and allowing the train to drive at the said speed limit or to stop, the said sections being successively even and odd, i.e., a same order of speed other than 0 or zero speed is obtained by a code of frequencies in the even sections and by another code of frequencies in the odd sections, characterized in that only any one of the following transition conditions can give rise to permission to drive:

For the start-up tripping;

Speeds other than zero, even towards speeds other than zero, odd Speeds other than zero, odd towards speeds other than zero, even;

For subsequent tripping;

Speeds other than zero, even towards speeds other than zero, odd;

Speeds other than zero, even towards zero speeds, odd;

Speeds other than zero, odd towards speeds other than zero, even;

Speeds other than zero, odd towards zero speeds, even.

According to one particularity of the invention, the first data and the second data, namely $V \neq 0$, even and $V \neq 0$, odd are memorized respectively in a first memory and a second memory, which are suitable for sending out a signal for permission to drive in compliance with four data items $V \neq 0$ even, $V \neq 0$ odd, V0 even, V0 odd when these latter appear after one of the first two in the order shown above.

The present invention also has as its object a passing logic device characterized in that a first input corresponding to the first data $V \neq o$, even is connected to a first time delay circuit which is connected on the one hand to one of the inputs of a first OR gate belonging to a first memory constituted by the said first OR gate and by a first AND gate, the output of the said first OR gate being connected to one of the inputs of the said first AND gate and the output of the said first AND gate forming a closed loop circuit with the other input of the said first OR gate and on the other hand, to an input of a third AND gate; in that a second input corresponding to the second data $V \neq 0$, odd is connected to a second time delay circuit which is connected on the one hand, to one of the inputs of a second OR gate belonging to a second memory constituted by the said second OR gate and by a second AND gate, the output of the said second OR gate being connected to one of the inputs of the said second AND gate and the input of the said second AND gate forming a closed loop circuit with the other input of the said second OR gate and on the other hand, to an input of a fourth AND gate; in that a third input corresponding to the third data V0 even is connected to a third time delay circuit which is connected to one of the inputs of a third AND gate whose output is connected to the other input of the said third OR gate whose output is connected to the other input of the said second AND gate; in that a fourth input corresponding to the fourth data V0 odd is concentrated to a fourth time delay circuit which is connected to one of the inputs of the said fourth AND gate whose output is connection to the other input of the said fourth OR gate whose output is connected to the other input of the said first AND gate; in that a fifth input corresponding to the feed source of the engine is connected to one of the inputs of a fifth AND gate belonging to a third memory constituted by a fifth OR gate and by a fifth AND gate, the output of the said fifth AND gate being connected on the one hand, to the other input of the said third AND gate and on the other hand, to the other input of the said fourth AND gate and forming a closed loop circuit with one of the inputs of the said fifth OR gate; in that the outputs of the first and second AND gates are connected respectively to each of the inputs of a sixth OR gate whose output is connected on the one hand, to the other input of the said fifth OR gate and on the other hand, to the output terminal of the logic passing device.

With reference to the diagrammatic FIGS. 1 and 2 herewith, an example of embodiment of the present invention, given merely by way of illustration and having no limiting character, will be described hereinbelow.

Figure 1:
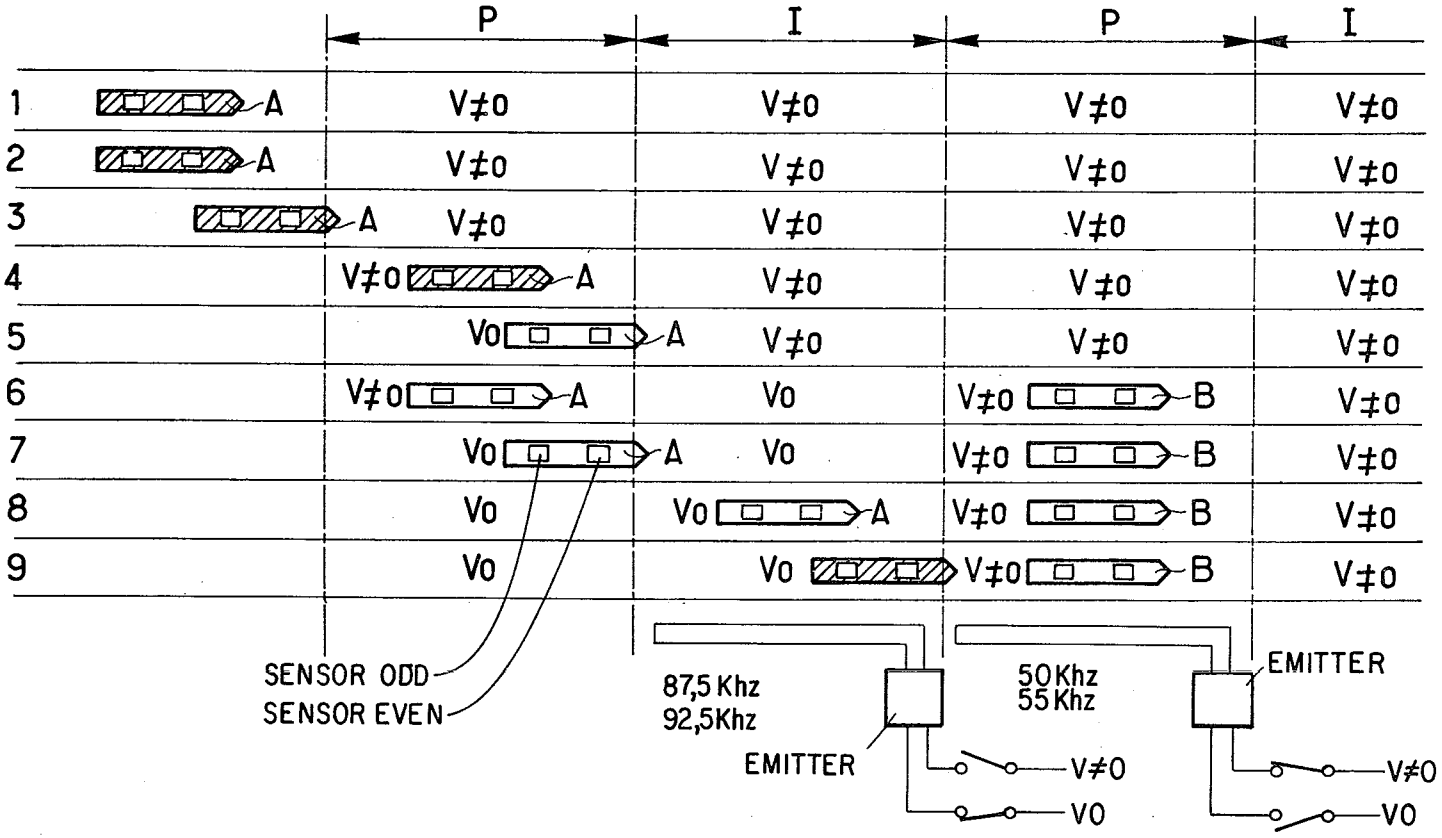
FIG. 1 is a diagram of the various sequences of the logic passing device as a function of the positions of the trains in relation to the railway track.

FIG. 1 shows a railway track separated into even sections P and odd sections I. The data circulating in the section on a closed loop circuit which is not shown, can be of four types: $V \neq 0$, meaning that the allowed speed limits have a certain value; $V_0$, meaning that the allowed speed is zero; even, meaning that the section is determined by a certain even code; odd, meaning that the section is determined by a certain odd code. Each speed is shown by a pair of discrete frequencies; for 90 km/h, the frequencies will be 50 and 55 kc/s in an even section and 52.5 and 57.5 kc/s in an odd section. Likewise, for 40 km/h, the frequencies will be 60 and 65 kc/s in an even section and 62.5 and 67.5 in an odd section. For 0 km/h, the frequencies will be 85 and 90 kc/s in an even section and 87.5 and 92.5 kc/s in an odd section. The symbol $V \neq 0$ means that the sum of all the speeds in the same section is calculated, those speeds not being zero. The symbol $V_o$ means that the speed is zero. The frequencies comprised between 50 and 92.5 kc/s are received on two receivers which are even and odd, in parallel and each supplies zero speed or speed different from zero data. Thus, one of the four types of data is obtained on board the engine.

When a track is equipped, from the signals point of view, a train situated in a downstream section in which the data $V \neq 0$ circulates will send the data $V_o$ into the upstream section.

In the 9 different non-limiting cases which it is possible to encounter and which are numbered from 1 to 9, a train A whose forward drive is shown by a triangle follows a train B shown in the same way.

The shaded trains show that the logic passing device is de-energized and that there is no permission for automatic pilot driving, but only for visual driving by the engine driver.

In the case 1, the train A is in a siding; the line is clear; each section indicates $V \neq 0$. In the case 2, it is decided to drive the train from left to right. The logic device is activated and the train starts visual driving. In the case 3, the train A enters a zone in which visual driving is still allowed. In the case 4, the train crosses the first section, driving still being visual. In the case 5, the train crosses the limits between the first even section and the second odd section and the logic passing device is set. Automatic pilot driving begins.

The permission condition, at the first setting of the logic device, is that the upstream $V \neq 0$ moves towards the downstream $V \neq 0$, in other words, that the even $V \neq 0$ moves towards the odd $V \neq 0$ or that the odd $V \neq 0$ moves towards the even $V \neq 0$. Indeed, if the upstream $V \neq 0$ moved towards the downstream $V_o$, there would be a non-acceptance.

The case 6 corresponds to that in which the logic device is set (for automatic piloting). In this case, the train A drives along a section in which the track is clear. In the case 7, the train A enters the stop section $V_o$. The transition from the upstream $V \neq 0$ towards the downstream $V_o$ is allowed. In the case 8, the train A drives through the stop section with the automatic pilot operating. In the case 9, the train A enters the non-clear section occupied by the train B. The logic device is de-energized.

Automatic piloting is no longer allowed. The case 9 corresponds to the upstream $V_o$ moving towards the downstream $V \neq 0$.

It follows that for the settings subsequent to the original setting, the permission conditions are as follows:

The even $V \neq 0$ towards the odd $V \neq 0$,
or the even $V \neq 0$ towards the odd $V_o$,
or the odd $V \neq 0$ towards the even $V \neq 0$,
or the odd $V \neq 0$ towards the even V0.

The above conditions as well as the original setting conditions are applicable even in the case of driving in an opposite direction or in the case of the unforseen deenergizing of a train.

Figure 2:
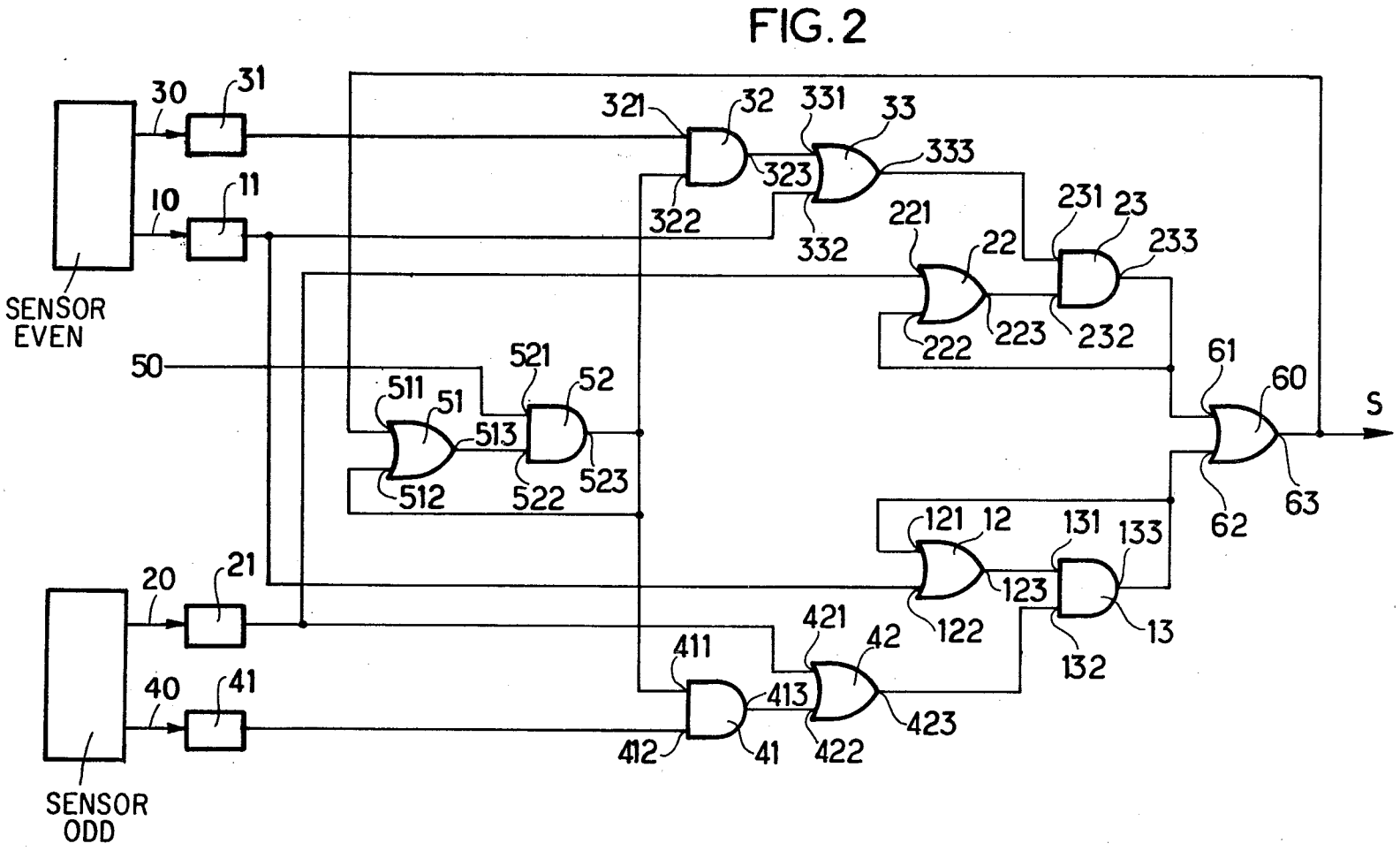
FIG. 2 is a circuit diagram of the logic passing device fulfilling the necessary conditions for sufficient safety.

The conditions are fulfilled by the logic device in FIG. 2. A first input 10 is in the logic state 1 if the sum of the even signals $V \neq 0$ is present. A time delay circuit 11, constituted, for example, by a capacitor, lengthens the signal by a time which can be 1/10 of a second. The time delay circuit 11 is connected to an input 122 of an OR gate, 12, whose output 123 is connected to the input 131 of an AND gate 13, whose output 133 is connected to the input 121 of the gate 12. The gates 12 and 13, as well as the reaction loop 133-121, constitutes a memory. On the other hand, the time delay circuit 11 is connected to input 332 of an OR gate, 33.

A second input 20 is in the logic state 1 if the sum of the odd $V \neq 0$ signals is present. A time delay circuit 21 identical to the circuit 11 is connected up to the input 20. The time delay circuit 21 is connected to an input 221 of an OR gate 22, whose output 223 is connected up to the input 232 of an AND gate 23. The output 233 of the gate 23 forms a closed loop circuit with the other input 222 of the gate 22, thus constituting a memory. The time delay circuit 21 is also connected up to an input 421 of an OR gate 42.

A time delay circuit 31 identical to the preceding circuits is arranged on a third input 30 corresponding to the sum cf the even signals $V_o$. That time delay circuits is connected to an input 321 of an AND gate 32 whose output 323 is connected to an input 331 of the OR gate 33. The output 333 of the OR gate 33 is connected to an input 231 of the AND gate 23 whose output 233 is connected to an input 61 of an OR gate 60, the other input 62 of the gate 60 receiving its data from the output 133 of the gate 13.

A time delay circuit 41 identical to the previous time delay circuits is arranged on a fourth input 40 corresponding to the sum of the V0 odd signals. The circuit 41 is connected to an input 412 of an AND gate whose output 413 is connected to an input 422 of the OR gate 42, which is itself connected to an input 132 of the AND gate 13.

A fifth input 50 corresponds to the feeding with electricity of the train on starting up. When current is supplied, it sends the state 1 to an input 521 of an AND gate 52 whose output 523 is connected on the one hand, to an input 322 of the AND gate 32 and on the other hand, to an input 411 of the AND gate 41. The output 63 of the OR gate 60 is connected by a reaction loop to an input 511 of an OR gate 51 whose other input 512 receives the signal from the output 523 of the AND gate 52. The gates 51 and 52 thus constitute a memory.

The general output terminal of the logic passing device is shown by S connected to the gate 63 of the OR gate 60. There appears, on the output terminal S, either the logic state 1, or permission to use the automatic pilot, or the state 0, or prohibition to use the automatic pilot.

An example of operation in a certain sequence will be given hereinbelow.

It is presumed, in a first phase, that the train is on a siding and is not fed with electricity. In that case, the supply source (50) is in the logic state 0, as are the input terminals 10 ($V \neq 0$ even; 30 (V0 even; 20 ($V \neq 0$ odd); 40 (V0 odd). The output terminal S also sends out the logic state 0.

The train is fed with electricity and does not leave the siding line, not comprising signals. The supply source 50 is in the logic state 1, the input terminals 10, 30, 20,

40 still being in the logic state 0. The output terminal S sends out the logic state 0.

The train comes into the first even section and receives the data V ≠ 0 even, hence logic state 1 prevails at the terminal 10. The terminals 30, 20, 40 being in the logic state 0, the output terminal S sends out the logic state 0: the train is still driven visually.

The train crosses the limit between the even and odd sections. In a first phase, subsequent to the time delay due to the circuit 11, the logic state 1 continues to prevail at the output of the circuit 11. Moreover, the terminal 20 (V ≠ 0 odd) receives the data 1. It follows that the OR gate 42 receives the data 1 on the output 421 and allows the data 1 to leave on the output 423 which drives the AND gate 13 at 132. The data 1, moreover, comes from 11 during a short period of time and drives the OR gate 12 at 122. The OR gate allows all the data 1 to pass providing that a 1 be present at one of the inputs of the OR gate.

The logic state 1 coming from 123 reaches the input 131 of the AND gate, which receives a 1 at the two inputs and sends out, at the output 133, also a 1. The logic state 1 is sent out to the input 62 of the OR gate 60, this allowing the passing of the data 1 at the output 63 and at the output S. This is automatic piloting. In a second phase, the time delay operation having ceased, the logic state 1 at the input 122 is replaced by the logic state 0. Nevertheless, the memory formed by the gates 12 and 13 is activated for the logic state 1 which existed previously at the output 133 to be transferred to the input 121 of the OR gate 12. The logic state 1 therefore continues to prevail at 123; it is transmitted to 131 and as the AND gate 13 receives the state 1 at 132, the presence of two states 1 at the two inputs of the AND gate 13 causes a logic state 1 to leave at 133. As previously, the output S sends out the state 1. Permission for automatic piloting is given, whereas the train has changed from the data V ≠ 0 even to V ≠ 0 odd.

If the train crosses the limit between the odd and even sections and it receives the data Vo even (terminal 30), the logic state 1 prevails at the terminal 30, the logic state 1 prevails at the terminals 50 and in a first phase, the terminal 20 (V ≠ 0 odd), subsequent to the time delay of the circuit 21, sends out the state 1. Subsequent to the loop which exists between the output 63 and the input 511 of the OR gate 51, the logic state 1 prevails at 511 and therefore at 513; the AND gate 52 receives, at each of its two inputs 521 and 522, the data 1 and then sends out the data 1 to 523. The gate 32 receives, at 321 and 322, the data 1 and sends out the same data 1 to 323.

The OR gate 33 allows the data 1 which leaves 333 and drives the AND gate 23 at 231, to pass. Subsequent to the time delay of the signal coming from the terminal 20, the memory constituted by the OR gate 22 and the AND gate 23 is set and in a second phase, when the time delay has ceased, the logic state 1 memorized at 222 drives the input 232 of the AND gate 23. The presence of two logic states 1 at 231 and 232 causes the generating of a signal 1 at 233, that signal crossing the OR gate 60 and leaving at S.

Thus, the change from V ≠ 0 odd to $V_o$ even leads to a permission for automatic pilotdriving.

The operations set forth in detail hereinabove and the sequence of possible transitions have been summarized in the table herebelow. The logic states 1 underlined meaning time delay logic states.

TABLE

| | | | (50) | (10) | (30) | (20) | (40) | S |
|---|---|---|---|---|---|---|---|---|
| Train not fed with electricity | | | 0 | 0 | 0 | 0 | 0 | 0 |
| Train fed with electricity | | | 1 | 0 | 0 | 0 | 0 | 0 |
| Train receives V ≠ O even | | | 1 | 1 | 0 | 0 | 0 | 0 |
| 1st phase. | Train receives | V≠O odd | 1 | $\underline{1}$ | 0 | 1 | 0 | 1 |
| 2nd phase. | " | " | 1 | 0 | 0 | 1 | 0 | 1 |
| 1st phase. | " | VO even | 1 | 0 | 1 | $\underline{1}$ | 0 | 1 |
| 2nd phase. | " | " | 1 | 0 | 1 | 0 | 0 | 1 |
| 1st phase. | " | V≠O even | 1 | 1 | $\underline{1}$ | 0 | 0 | 1 |
| 2nd phase. | " | " | 1 | 1 | 0 | 0 | 0 | 1 |
| 1st phase. | " | VO odd | 1 | $\underline{1}$ | 0 | 0 | 1 | 1 |
| 2nd phase. | " | " | 1 | 0 | 0 | 0 | 1 | 1 |
| 1st phase. | " | V≠O even | 1 | 1 | 0 | 0 | $\underline{1}$ | 1 |
| 2nd phase. | " | " | 1 | 1 | 0 | 0 | 0 | 0 |
| 1st phase. | " | VO odd | 1 | $\underline{1}$ | 0 | 0 | 1 | 1 |
| 2nd phase. | " | " | 1 | 0 | 0 | 0 | 1 | 1 |
| 1st phase. | No receiving | | 1 | 0 | 0 | 0 | $\underline{1}$ | 1 |
| 2nd phase. | " | | 1 | 0 | 0 | 0 | 0 | 0 |

It should be observed that the logic state 0 obtained at S is equivalent to a change which has not been permitted from V0 odd to V ≠ 0 even. If there is no receiving, for any cause whatsoever, the output signal is also 0, since, for reasons of railway safety, any absence of data leads to the stopping of the automatic pilotdriving.

The logic passing device according to the present invention can be applied in all railway systems comprising sections having signals formed by closed loop circuits.

Applications affording a particular advantage come within the field of underground railways and more particularly of tyre-mounted underground trains.

What is claimed is:

1. Automatic railway piloting method for a track divided into sections, each section comprising a closed loop circuit fed by an emitter on the ground sending out signals whose frequency is variable according to the speed limit other than zero or zero speed which the train must keep to in the said section, the engine of the train being equipped with sensors receiving the said signals and allowing the train to drive at the said speed limit or to stop, in which case, the automatic piloting is changed over to visual driving, the said sections being successively even and odd and having a code of frequencies in the even sections and another code of frequencies in the odd sections corresponding to each speed different from zero and to zero speed, said method comprising establishing only any one of the following transition conditions to give rise to a permission to drive:

For the start-up tripping;

Speeds other than zero, even towards speeds other than zero, odd

Speeds other than zero, odd towards speeds other than zero, even

For subsequent tripping;

Speeds other than zero, even towards speeds other than zero, odd

Speeds other than zero, even towards zero speeds, odd

Speeds other than zero, odd towards speeds other than zero, even

Speeds other than zero, odd towards zero speed, even.

2. Logic passing method according to claim 1, wherein the first data and the second data, namely V ≠ 0, even and V ≠ 0, odd are memorized respectively in a first memory and a second memory, which are suitable for sending out a signal for permission to drive in compliance with four data items V ≠ 0 even, V ≠ 0 odd, V0 even, V0 odd when these latter appear after one of the first two in the order shown in claim 1.

3. Logic passing device implementing an automatic railway piloting method comprising a track divided into sections, each section comprising a loop fed by an emitter on the ground sending out signals whose frequency is variable according to the speed limit other than zero or zero speed which the train must keep to in the said section, the engine of the train being equipped with sensors receiving the said signals and allowing the train to drive at the said speed limit or to stop, in which case the automatic piloting is changed over to visual driving the said sections being successively even and odd and having a code of frequencies in the even sections and another code of frequencies in the odd sections corresponding to each speed different from zero and to zero speed such that only any one of the following transition conditions is able to give rise to a permission to drive:

For the start-up tripping;

Speeds other than zero, even towards speeds other than zero, odd Speeds other than zero, odd towards speeds other than zero, even;

For subsequent tripping;

Speeds other than zero, even towards speeds other than zero, odd Speeds other than zero, even towards zero speeds, odd Speeds other than zero, odd towards speeds other than zero, even Speeds other than zero, odd towards zero speed, even;

the first data and the second data namely V ≠ 0, even and V ≠ 0, odd are memorized respectively in a first memory and a second memory, which are suitable for sending out a signal for permission to drive in compliance with four data items V ≠ 0 even, V ≠ 0 odd, V0 even, V0 odd when these latter appear after one of the first two in the order shown, said device comprising a first input corresponding to the first data V ≠ 0, even connected to a first time delay circuit which is connected on the one hand to one of the inputs of a first OR gate belonging to a first memory constituted by the said first OR gate and by a first AND gate, the output of the said first OR gate being connected to one of the inputs of the said first AND gate and the output of the said first AND gate forming a closed loop circuit with the other input of the said first OR gate and on the other hand, to an input of a third AND gate; a second input corresponding to the second data V ≠ 0, odd connected to a second time delay circuit which is connected on the one hand, to one of the inputs of a second OR gate belonging to a second memory constituted by the said second OR gate and by a second AND gate, the output of the said second OR gate being connected to one of the inputs of the said second AND gate and the output of the said second AND gate forming a closed loop circuit with the other input of the said second OR gate and on the other hand, to an input of a fourth AND gate; a third input corresponding to the third data V0 even connected to a third time delay circuit which is connected to one of the inputs of a third AND gate whose output is connected to the other input of the said third OR gate whose output is connected to the other input of the said second AND gate; a fourth input corresponding to the fourth data V0 odd connected to a fourth time delay circuit which is connected to one of the inputs of the said fourth AND gate whose output is connected to the other input of the said fourth OR gate whose output is connected to the other input of the said first AND gate; a fifth input corresponding to the feed source of the engine connected to one of the inputs of a fifth AND gate belonging to a third memory constituted by a fifth OR gate and by a fifth AND gate, the output of the said fifth AND gate being connected on the one hand, to the other input of the said third AND gate and on the other hand, to the other input of the said fourth AND gate and forming a closed loop circuit with one of the inputs of the said fifth OR gate; the outputs of the first and second AND gates being connected respectively to each of the inputs of a sixth OR gate whose output is connected on the one hand, to the other input of the said fifth OR gate and on the other hand, to the output terminal of the logic passing device.

* * * * *